US006152746A

United States Patent [19]

Brown

[11] Patent Number: 6,152,746

[45] **Date of Patent: *Nov. 28, 2000**

[54] SCREENED CABLE TERMINATING FERRULE

[75] Inventor: Alan Peter Brown, Basingstoke, United Kingdom

[73] Assignee: ITT Manufacturing Enterprises, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/146,382

[22] Filed: Sep. 1, 1998

[30] Foreign Application Priority Data

Sep. 12, 1997 [GB] United Kingdom ..... 9719528

[51] Int. Cl.[7] ..... H01R 4/66; H01R 13/648

[52] U.S. Cl. ..... 439/99

[58] Field of Search ..... 439/310, 99, 882, 439/610, 98; 174/65 R, 84 R, 74 R; 16/108

[56] References Cited

U.S. PATENT DOCUMENTS

| | | | |
|---|---|---|---|
| 4,239,313 | 12/1980 | Parr . | |
| 4,453,798 | 6/1984 | Asick et al. | 439/610 |
| 4,613,199 | 9/1986 | McGeary | 439/585 |
| 4,822,286 | 4/1989 | Bianca | 439/610 |
| 4,961,711 | 10/1990 | Fujiura et al. | 439/357 |
| 5,186,655 | 2/1993 | Glenday et al. | 439/583 |
| 5,466,175 | 11/1995 | Onada . | |
| 5,616,887 | 4/1997 | Kirma | 174/84 R |
| 5,679,926 | 10/1997 | Maloney et al. | 174/65 R |
| 5,691,506 | 11/1997 | Miyazaki et al. | 174/65 R |
| 5,707,253 | 1/1998 | Matsumoto et al. | 439/99 |
| 5,895,291 | 4/1999 | Furio et al. | 439/610 |
| 5,921,700 | 1/1999 | Haver et al. | 16/108 |
| 5,929,383 | 7/1999 | Marik et al. | 174/78 |

FOREIGN PATENT DOCUMENTS 2 374 758 12/1977 France .

*Primary Examiner*—Khiem Nguyen
*Assistant Examiner*—Hae Moon Hyeon
*Attorney, Agent, or Firm*—Thomas L. Peterson

[57] ABSTRACT

A terminating ferrule (10) for connecting a screen (34) of a screened cable (30) to an electrical connector (46) and a method for its installation. The ferrule (10) comprises inner (12) and outer (14) tubular portions with front ends connected by an annulus (18) and forming a rearwardly - opening cavity (22) into which the screen (34) and jacket (32) of the cable (30) can be inserted to make electrical contact between the screen and the ferrule and to mechanically hold the ferrule to the jacket. The ferrule is engaged with a rearward projection (50, 54, 62) of connector body (56, 60) to provide an electrical connection between the screen (34) and connector body.

7 Claims, 6 Drawing Sheets

SCREENED CABLE TERMINATING FERRULE

BACKGROUND OF THE INVENTION

The present invention relates to a method and apparatus for termination of a screen of a cable. In particular, the invention relates to an improved ferrule for terminating the screen of a signal carrying cable and a method of connection of a screened cable to an electrical connector.

Screened cables, for example screened twisted pairs (STP) and coaxial cables, commonly have their screen terminated by one or more crimped ferrules, In the case of STP cables the screen is commonly in the form of a foil or plating on the inside of a plastic sleeve. The foil screen commonly includes a drain wire running along the length of the cable in contact with the foil. Termination of a foil screen is commonly performed by stripping back both the foil and jacket of the cable, folding the exposed drain wire back over the jacket and crimping a ferrule around the jacket and the drain wire. The purpose of the screen is to shield the twisted wire pairs from external electrostatic or electromagnetic energy.

In an alternative termination commonly employed with coaxial cables, the cable is prepared prior to termination by stripping back a section of the cable's jacket to reveal a braided screen. A first cylindrical ferrule is slid onto the cable over the jacket and the screen is then wrapped back over the first ferrule. A second, slightly larger ferrule is then slid over the first ferrule and the screen is crimped into place. The crimping force secures the wrapped back screen between the two ferrules and also secures the first ferrule to the jacket. Signal carrying element(s) of the cable is/are then terminated to a connector, the body of which is connected to the ferrules to continue the shielding. In this case the screen continuity is primarily intended to maintain the characteristic impedance of the cable.

The screen can be a braiding that consists of a of a plurality of fine wires woven into a hollow cylinder disposed between the signal carrying element(s) of the cable and the jacket.

Both of the above described termination procedures result in a drop in the screening performance of the cable at the cable-connector interface. In the case of crimping the screen between the two ferrules, the crimp does not produce uniform engagement between the ferrules and the screen. In the case of the drain wire, while the cable is completely screened about its circumference by the foil, the screen-connector interface is formed by a single wire crimped to a ferrule. The connection is formed by only a few millimeters of contact between the wire and ferrule and screening performance is therefore greatly reduced. Furthermore, in both cases there is a gap in the screening at the cable connector interface allowing leakage at the terminated end of the cable.

An alternative applicant explored to overcome these problems involved wrapping the foil screen back over the jacket of the cable and crimping a connector body over the wrapped back foil. The foil is commonly in the form of a sheet wrapped around the signal carrying element(s), normally with a longitudinal seam. The sheet, when wrapped back over the jacket, is not sufficiently wide to completely encircle the cable and therefore results in a gap such that the screening performance in this region is still reduced. Furthermore, the foil commonly tears and kinks during wrapping back, therefore reducing screening effectiveness.

The present invention seeks to provide a screen terminating ferrule for connecting a screened cable to a connector, the connection between the screen, ferrule and connector being simple and having improved performance over those described. The present invention also seeks to provide a method for the termination of screened cables using the screen terminating ferrule.

SUMMARY OF THE INVENTION

According to an aspect of the present invention, there is provided a terminating ferrule for connecting a screen of a screened cable to the body of an electrical connector, the ferrule comprising inner and outer tubular portions with front ends connected together. The ferrule defines a rearwardly opening cavity into which the screen, or screen and jacket, of a screened cable can be inserted to make electrical contact between the ferrule and the screen. This permits engagement and therefore electrical connection of the ferrule with the connector body.

The ferrule may be formed from a single hollow cylinder drawn back over itself to form the inner and outer tubular portions and an annular portion that connects their front ends. The ferrule may be formed from individual inner and outer tubular elements joined together electrically and mechanically by an annular element. The ferrule is preferably constructed to completely enclose the front portion of the screen, or screen and jacket, of the inserted cable.

The outer tubular portion may be deformable under a crimping force. The inner tubular portion is preferably substantially non-deformable by a crimping force applied through the outer tubular portion due to the greater rigidness for a smaller diameter tube and due to less concentration of crimping forces.

The invention also includes the combination of an electrical connector and the ferrule, with the ferrule engaged with a projection on the connector body. The projection on the body may be an elongate tongue which may be securable to the ferrule by a crimp ring. The connector body may include a ground plate having a semi-cylindrical projection that engages the ferrule at a position opposite the tongue. The projection on the body may be a sleeve extending 360° about an axis and securable to the ferrule by crimping the projection around the ferrule.

According to a further aspect of the present invention, there is provided a method of connecting a screen of a screened cable to an electrical connector using a terminating ferrule described in the preceding aspect of the invention, including the steps of;

a) making an incision of a predetermined length through the jacket at the stripped end of the cable, b) sliding the ferrule over the stripped portion of the cable, d) inserting the screen, or screen and jacket, of the cable into the cavity of the ferrule, and h) engaging the ferrule with a connector body.

The incision may be made parallel to the cable axis. The method may include any of the steps of;

c) holding the cable jacket at a predetermined distance from an end of the cable to be terminated, and gyrating the ferrule and stripped portion of the cable about a center axis of the held cable to form a bellmouth at the jacket end.

e) crimping the outer tubular portion of the ferrule around the screen, or screen and jacket, of the cable.

f) bending a drain wire of the stripped portion of the cable back over the ferrule.

g) trimming the wire flush with an end of the ferrule furthest from the terminated end of the cable.

The step (h) of engaging the ferrule with a connector body may include the steps of;

i) attaching a ground plate to the connector body, and ii) engaging the ferrule with the ground plate.

In order that the invention and its various other preferred features may be understood more easily, some embodiments of the invention will now be described, by way of example only, with reference to the drawings.

DESCRIPTION OF THE PREFERRED EMBODIMENTS

Figure 2:
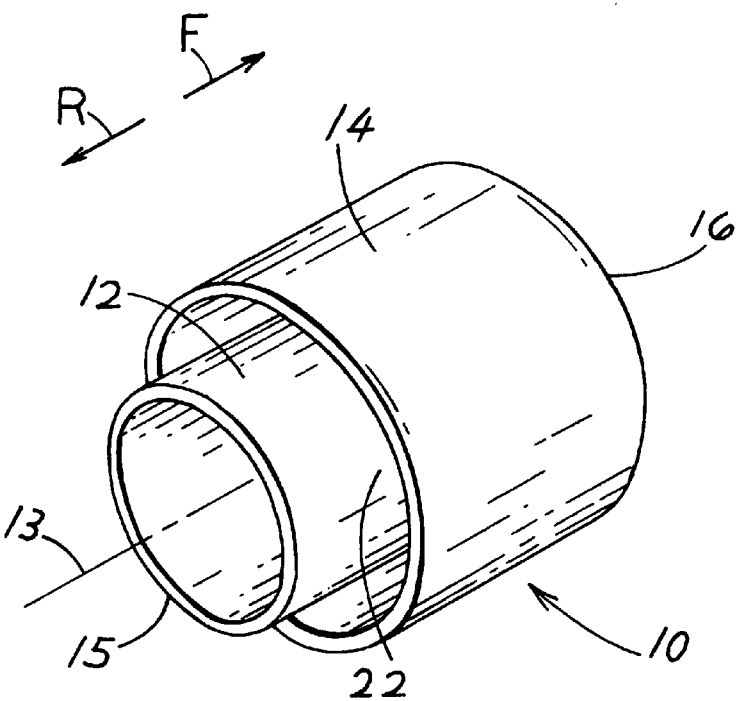
FIG. 2 is a rear isometric view of the ferrule of FIG. 1.
Figure 1:
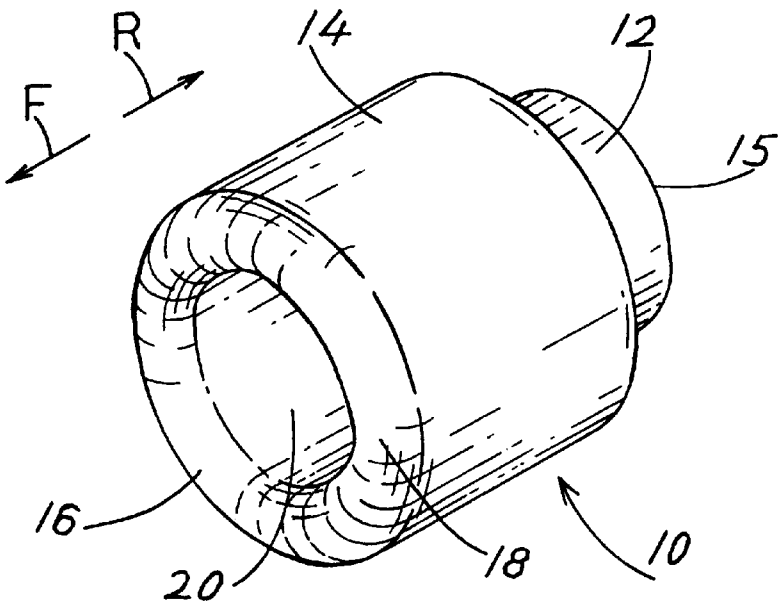
FIG. 1 is a front isometric view of a terminating ferrule constructed in accordance with the invention.

FIGS. 1 and 2 show a ferrule 10 that includes an inner tubular portion 12 in the form of a cylinder and an overlapping outer tubular portion 14 in the form of a cylinder. The cylinders are concentric with an axis 13. The tubular portions 12, 14 are electrically and mechanically joined at their front ends by an annulus 18 that radially (with respect to axis 13) spaces the tubular portion front ends. The inner surface of the inner cylinder 12 defines a through hole 20 extending between the ends 15, 16 of the cylinders 12, 14. The outer surface of the inner cylinder 12 in combination with the inner surface of the outer cylinder 14 and the annulus 18, define a cavity 22 that opens rearwardly R.

The ferrule 10 is formed from an electrically conductive material. It is preferably formed by drawing back an end of a hollow cylinder over itself in an overlapping manner to form the inner cylinder 12 joined at one end 16 to the outer cylinder 14. The ferrule 10 could however be formed from separate elements by for example welding together the inner cylinder 12, outer cylinder 14 and annulus 18.

Figure 3:
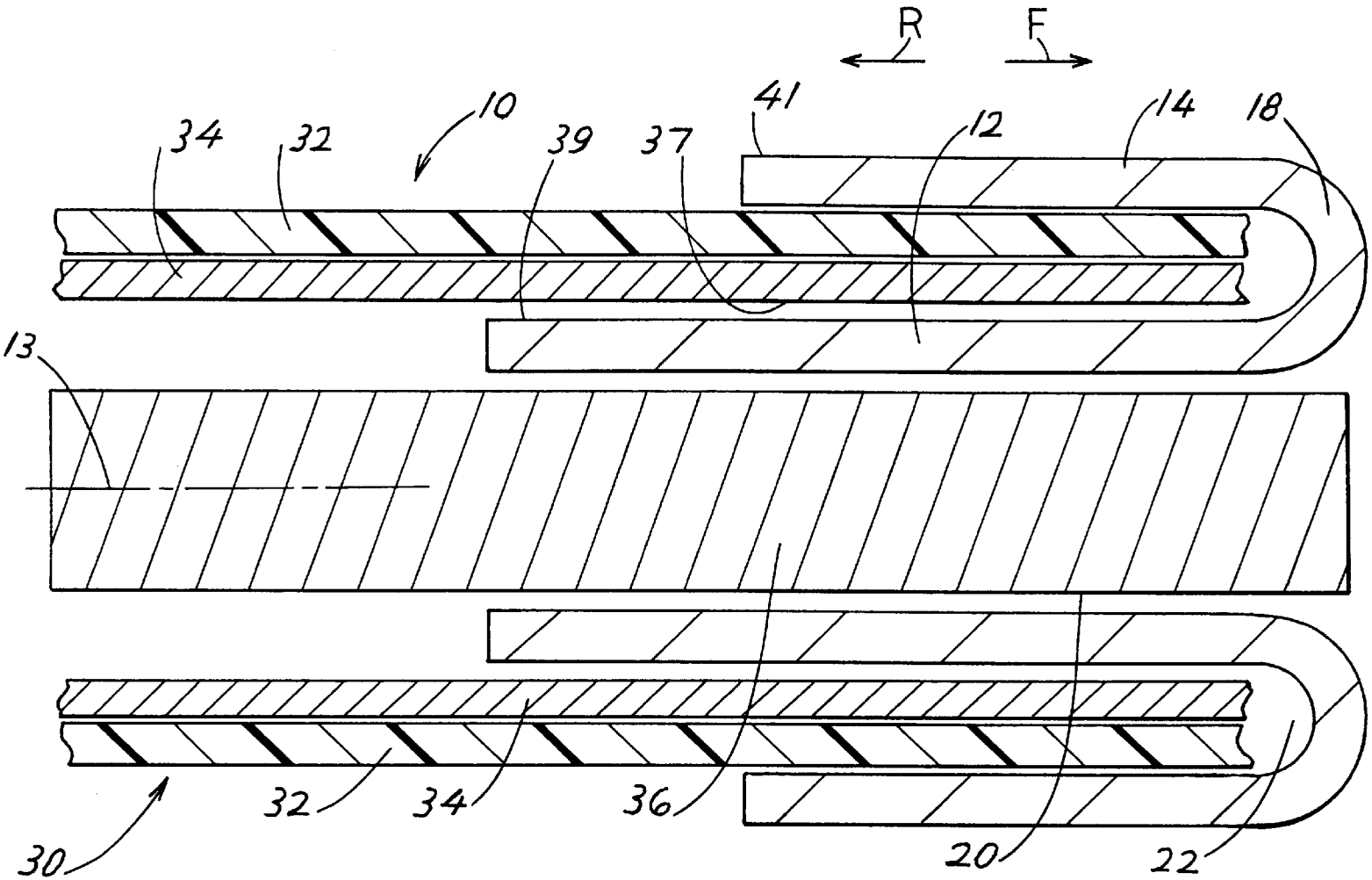
FIG. 3 is a cross sectional view of the ferrule of FIGS. 1 and 2 with a screened cable inserted in the cavity of the ferrule.

FIG. 3 shows the ferrule 10 with a cable 30 inserted into the ring-shaped or annular cavity 22. The cable 30 includes a jacket 32 that is usually of a dielectric polymer, a shield or screen 34 lying within the jacket, and at least one signal carrier 36 lying within the shield, such as a twisted wire pair. The cable 30 is inserted into the ferrule 10 so the jacket 32 and shield 34 are slid into the cavity 22, while the signal carrier 36 and any insulating element between the signal carrier 36 and shield 34 is slid through and foward of the hole 20. It is preferable that the jacket 32 and shield 34 are stripped back by a predetermined length to allow a sufficient amount of the signal carrier 36 to extend forwardly of the ferrule for termination to a contact of a connector. By using a ferrule of this configuration it is possible to ensure that a connection is made to all 360° of the circumference of the inner surface 37 of the cable screen and to continue this complete screening through the body of a connector.

Figure 4:
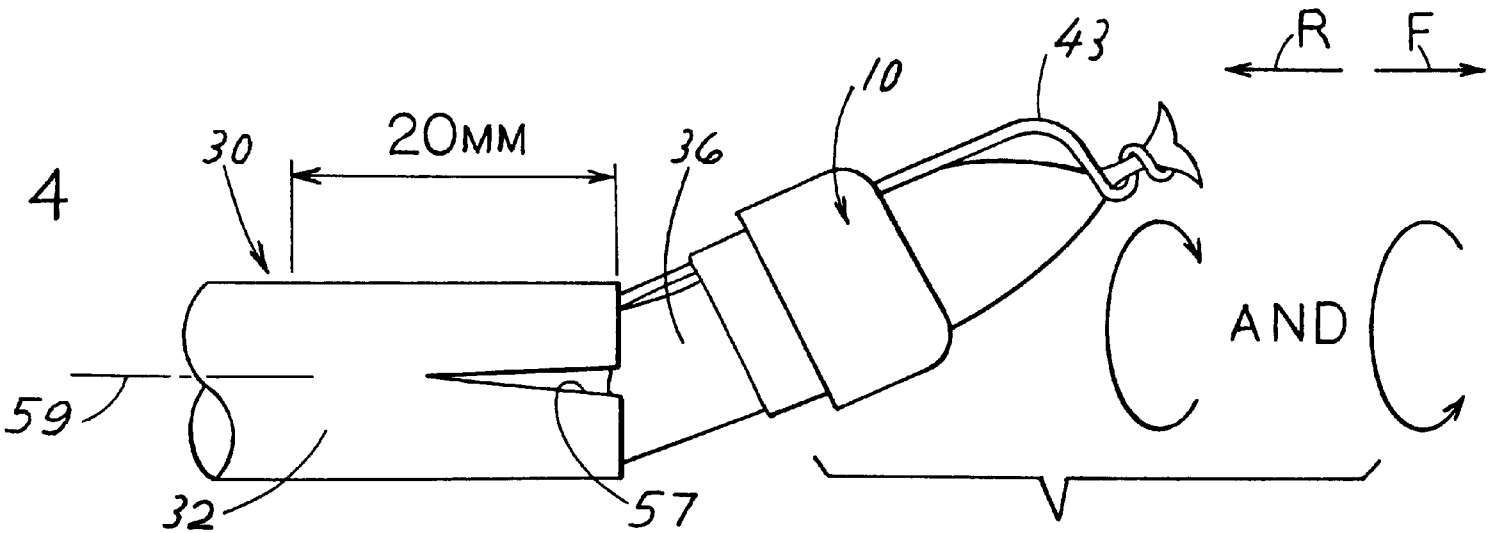
FIG. 4 is a side elevation view of the ferrule of FIG. 2 and of a prepared screened cable, shown during the process of terminating them to each other.
Figure 5:
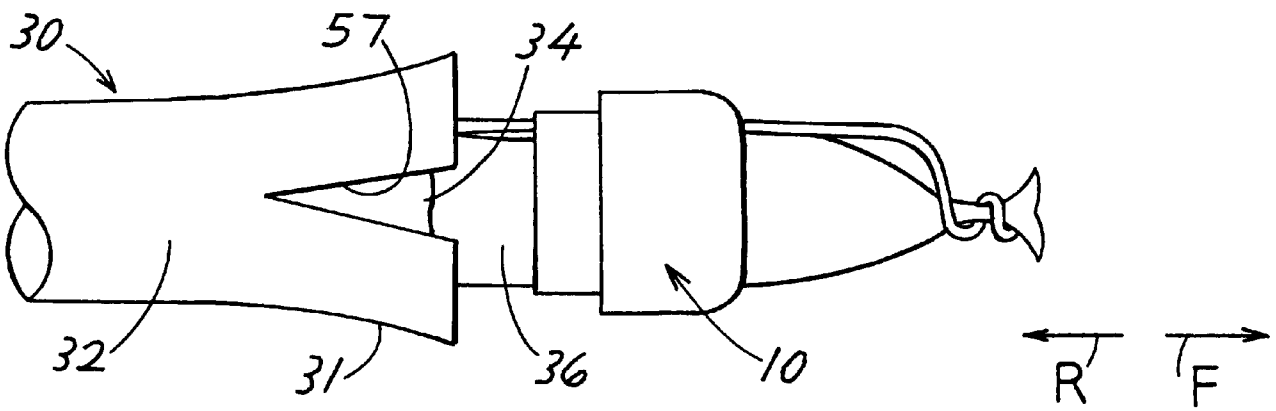
FIG. 5 is a side elevation view of the ferrule and screened cable of FIG. 4, after their termination.

The rear end 39 of the inner tubular portion 12 preferably extends rearwardly by a plurality of millimeters further than the outer tubular portion 14. This allows a technician to "wiggle" the rear end 39 until it securely enters the space between the screen and signal carrier, before having to assure that the rear end 41 of the outer tubular portion moves around the jacket. The rear ends of the tubular portions can be beveled to help in the installation.

Where a drain wire is present, it is not stripped back with the jacket 32 and shield 34. To facilitate insertion into the ferrule 10, it is preferable that the drain wire 43 (FIG. 4) is temporarily wrapped around the front end of the signal carrier 36 and any plastic film that may be present, as shown in FIGS. 4 and 5. Subsequent to insertion into the ferrule 10, the drain wire is unwrapped from the signal carrier 36 and bent back over the ferrule 10. The wire is then trimmed flush with the rear end of the ferrule and may subsequently be terminated to a connector with the ferrule 10.

In the case of a coaxial cable having a braided shield 34, there is usually sufficient flexibility in the shield 34 and jacket 32 for them to be slid straight into the cavity 22. In cables such as twisted pairs, there may be less flexibility in the jacket 32 and it may be necessary to make one or more incisions at the insertion end of the jacket 32 to allow the shield 34 and jacket 32 to pass over the inner cylinder 12.

FIG. 4 shows that a pair of slits 57 have been cut into the cable jacket 32. It is preferable that the slits be enlarged into a bellmouth as is illustrated in FIGS. 4 and 5. Once the slits or incisions are made, the ferrule 10 is slid over the signal carrier 36 and any drain wire or film present (other than the screen). The jacket 32 is then held by a worker's fingers or by a tool at a predetermined distance, preferably 20 mm, from an end of the jacket 32. The ferrule 10, signal carrier 36 and any drain wire or plastic film are then gyrated, or revolved about the axis 59 of the held cable 30 in clockwise and counterclockwise directions as is shown in FIG. 4 to create the bellmouth 31 shown in FIG. 5. The ferrule is slid rearwardly R so the enlarged ends of the jacket 32 and shield 34 are inserted into the cavity 22 of the ferrule.

Figure 6:
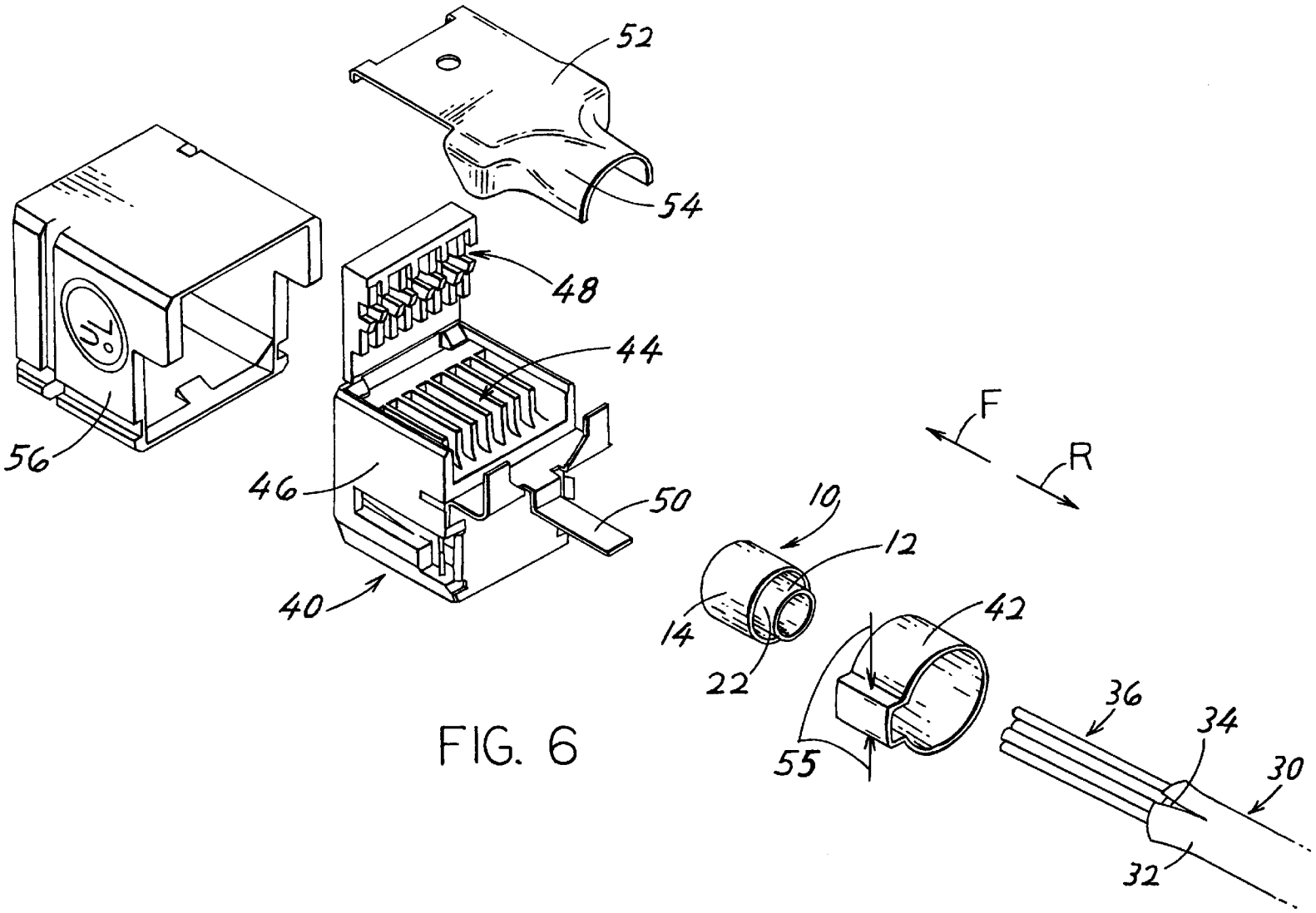
FIG. 6 is an exploded view of a connector assembly incorporating the ferrule of FIG. 2.
Figure 6A:
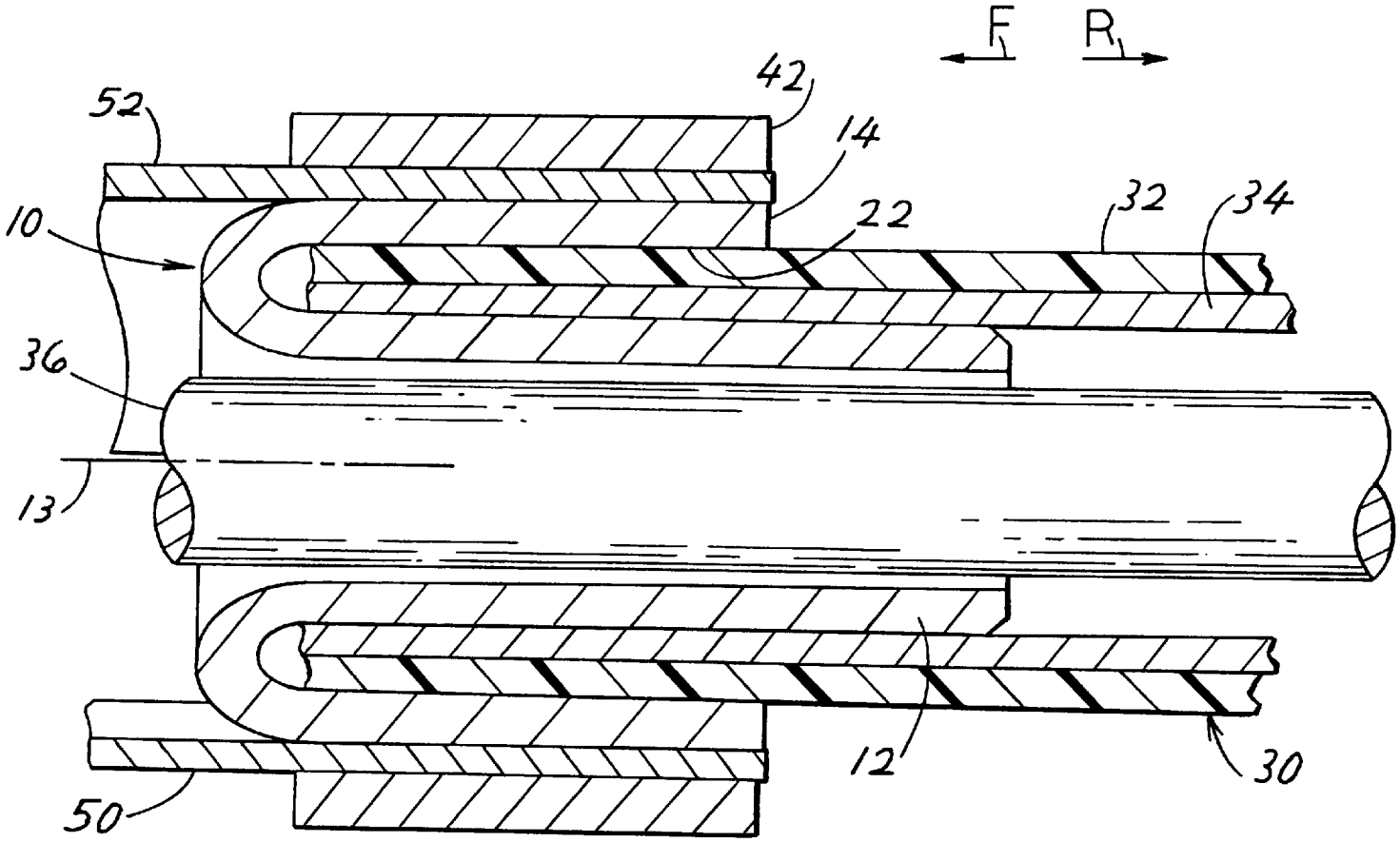
FIG. 6A is a sectional view of assembled and crimped parts of the connector assembly of FIG. 6.

FIG. 6 shows parts of a type 808 connector assembly 40. The cable 30 is inserted into the ferrule 10 as described previously. A crimp ring 42 is then fed onto the cable past (rearward of) the ferrule. The signal carrier 36 of the cable 30 is terminated to a contact(s) 44 of a connector 46 by inserting stripped wires and then closing a lid 48 as is known in the art. The length of the stripped wires are predetermined such that, once the wires are terminated, the ferrule 10 is positioned in contact with a projecting tongue 50 that then lies on the outside of the ferrule. A ground plate 52 is attached to the connector 46 over the lid 48. The ground plate 52 has a semi cylindrical projection 54 that engages the outside of the ferrule 10 at a position opposite the tongue 50. The crimp ring 42 is slid forward along the cable to a position where it encircles the tongue 50, the semi cylindrical projection 54 and the ferrule 10. The crimp ring 42 is then tightened, as by applying forces indicated at 55, to clamp everything together, as shown in FIG. 6A. The clamping or crimping causes deformation of the outer tubular portion 14, but may not produce folds in the outer tubular portion. An outer conducting body 56 is then slid over the connector 46 to complete the termination of the cable 30 to the connector assembly 40. The outer body 56 is in contact with portions of the tongue 50 and the ground plate 52 and is therefore connected to the screen 34 of the cable 30 via the ferrule 10.

Figure 7:
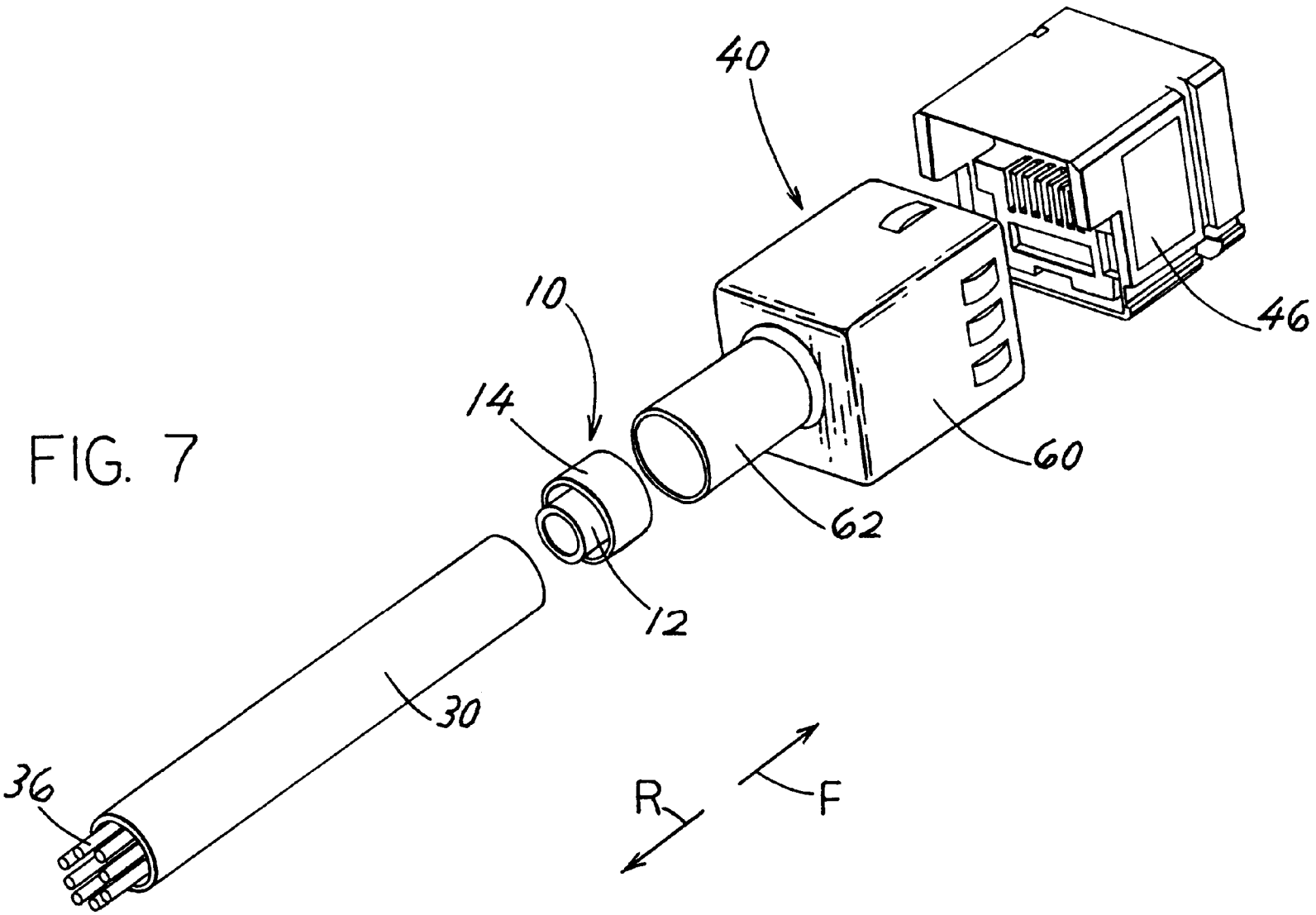
FIG. 7 is an isometric view of a connector of another embodiment of the invention, which includes the ferrule of FIG. 2.

FIG. 7 shows a modified version of the type 808 connector assembly 40 of FIG. 6. Parts in FIG. 6, including the ground plate 52, the crimp ring 42, the tongue 50 and the outer body 56, are replaced in FIG. 7 by a single shield body 60 having a cylindrical projection 62. After the ferrule 10 has been installed on the cable by having the cable jacket and screen received in the ferrule cavity, the projection 62 of the shield body 60 is slid around the signal carrier 36 of the cable and around the ferrule 10. The projection 62 is then clamped by permanent deformation, as in a hexagonal crimp, around the ferrule to secure the connector assembly 40 to the cable and also to connect the screen 34 of the cable 30 to the shield body 60 via the ferrule 10. The shield body may be initially slid onto the cable to lie rearward of the stripped cable end, and later slid forwardly into position, where desired.

It will be appreciated that the example embodiments illustrated are susceptible of modification and the inventive principle involved is applicable to any cables having a screen for connection to any form of compatible connector such as coaxial cables and connectors.

It should also be appreciated that the invention is applicable to connectors presently in use. By replacing a pair of crimped ferrules used in the prior art in the form of separate sleeves, with the terminating ferrule of the present invention, the connection between a connector and screen is improved. By also using a ground plate 52 (FIG. 6) to provide further contact between the connector and ferrule 10, the connection may be further improved. The connection assembly shown in FIG. 6 shows a known 808 type connector adapted for improved screening connection. The design of the ground plate 52 could be varied according to the connector it is to be used with and how it is to be attached.

It is preferable that the construction of the ferrule 10 be such that the outer cylinder 14 deforms under a clamping or crimping force whilst the inner cylinder 12 remains substantially unaffected. In this way, the ferrule 10 may be crimped to the cable 30 without any disruption to the signal carrier 36 and in the case of twisted pairs will not affect the lay of the cable thereby resulting in no change in the cable data transmission performance.

Although the inner and outer cylindrical portions 12, 14 (FIG. 2) of the ferrule may have the same wall thickness, the inner portion 12 is more resistant to deformation during crimping of the crimp ring 42 (FIG. 6) or of the screening body projection 62 (FIG. 7). One reason is that the greater ratio of wall thickness to cylinder diameter for the inner cylinder portion 12 results in greater resistance to deformation. Another reason is that the crimping forces are more evenly distributed when they reach the inner portion.

The integral connection of the inner and outer ferrule portions makes it easier to hold and manipulate them. Although a separate short inner sleeve could be slid inside the cable screen, it is difficult to hold and manipulate such an inner sleeve. In the figures, (e.g. FIG. 4) the outside diameter of the ferrule 10 is 14 mm, so even the entire ferrule is not especially easy to hold and move. This is a reason why previous terminations have often involved placing a large sleeve around the braiding or other screen and then folding the braiding back around the large sleeve. The ability to slide the inner cylindrical portion 12 of the ferrule inside of the cable screen, enables a small diameter inner ferrule portion to directly contact a metalized inner surface of a foil screen, which is often not metalized on its outside (on the outside of a plastic film that holds the foil). The integration assures that the outer ferrule portion is reliably electrically connected to the inner ferrule portion, even when the cable jacket lies outside the cable screen at a single clamp or crimp location.

Thus, the invention provides apparatus and methods for terminating a connector body to the screen of a screened cable. A ferrule is provided which has concentric inner and outer tubular portions with front ends that are joined, to form a rearwardly-opening cavity. The inner tubular portion is slid between the screen and the signal carrier (twisted wire pair, central coaxial conductor, etc.) of a screened cable, while the outer tubular portion is slid around the screen and preferably also around an insulative cable jacket. A tubular portion such as a crimp ring 42 or screening body rearward tubular projection 62, is slipped around the ferrule outer tubular portion and clamped or crimped thereto. While the outer tubular portion is deformed during clamping or crimping to assure firm engagement of the screen that is sandwiched between the inner and outer ferrule portions, the small diameter inner ferrule portion is generally not deformed.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A combination of a connector and a cable where the cable includes a signal carrier, an electrically conductive screen surrounding said signal carrier, and a polymer jacket surrounding said screen, and where said connector includes a connector body with a rearward projection to be connected to said screen, comprising:

a ferrule of electrically conductive material having inner and outer concentric tubular portions with front ends that are joined, to leave a rearwardly-opening cavity, with said inner tubular portion extending further rearward than said outer tubular portion;

said screen and said jacket lying in said cavity, and said rearward projection of said body lying around said outer tubular portion and being crimped to said outer tubular portion while said outer tubular portion is crimped to said jacket.

2. A combination of a connector and a cable where the cable includes a signal carrier, an electrically conductive screen surrounding said signal carrier, and a dielectric polymer jacket surrounding said screen, and where said connector includes at least one signal contact to be connected to said signal carrier and a connector body with a rearward projection to be connected to said screen, comprising:

a ferrule of electrically conductive material having inner and outer concentric tubular portions with front ends that are joined, to leave a rearwardly-opening cavity;

said cable screen and said cable jacket both lie within said cavity;

said inner tubular portion lies radially inside said screen, said outer tubular portion lies outside at least said screen and said jacket, and said rearward projection lies outside said outer tubular portion, with said outer tubular portion being crimped with said rearward projection and jacket around said screen.

3. A connector which is terminated to a screened cable that includes a screen and a dielectric jacket around the screen, comprising:

a ferrule that includes inner and outer tubular portions having front ends that are joined, said ferrule forming a rearwardly opening cavity between said tubular portions, with said jacket and screen lying in said cavity;

a crimp ring that lies around said outer tubular portion and that has been tightened to deform said outer tubular portion to tightly press said screen against at least one of said tubular portions of said ferrule while said crimp ring remains tightened around said ferrule.

4. A combination of a connector and a cable where the cable includes a signal carrier and an electrically conductive screen surrounding said signal carrier, and where said connector includes at least one signal contact to be connected to said signal carrier, comprising:

a ferrule of electrically conductive material having inner and outer concentric tubular portions with front ends that are joined, to leave a rearwardly-opening cavity;

said cable screen lies within said cavity;

said inner tubular portion lies radially inside said screen, and said outer tubular portion is crimped around said screen at a location of said screen that is supported by said inner tubular portion;

said inner tubular portion of said ferrule extends further rearward than said outer portion of said ferrule and said inner tubular portion has a rear end which is, beveled whereby to facilitate initial insertion of said inner tubular portion within said screen.

5. A combination of a connector and a cable where the cable includes a signal carrier, an electrically conductive screen surrounding said signal carrier, and a dielectric polymer jacket surrounding said screen, and where said connector includes at least one signal contact to be connected to said signal carrier and a connector body, comprising:

a ferrule of electrically conductive material having inner and outer concentric tubular portions with front ends that are joined, to leave a rearwardly-opening cavity;

said inner tubular portion lies radially inside said screen and said outer tubular portion lies outside said screen and is crimped around said screen, with both said cable screen and said cable jacket lying within said cavity.

6. A combination of a connector and a cable where the cable includes a signal carrier, an electrically conductive screen surrounding said signal carrier, and a dielectric polymer jacket surrounding said screen, and where said connector includes at least one signal contact to be connected to said signal carrier and a connector body, comprising:

a ferrule of electrically conductive material having inner and outer concentric tubular portions with front ends that are joined, to leave a rearwardly-opening cavity;

said inner tubular portion lies radially inside said screen and said outer tubular portion lies outside at least said screen and is crimped around said screen;

said connector body includes a rearward projection that lies against the outside of said outer tubular portion; and including a crimp ring that lies around and is crimped to said projection and to said outer tubular portion.

7. A combination of a connector and a cable where the cable includes a signal carrier, an electrically conductive screen surrounding said signal carrier, and a dielectric polymer jacket surrounding said screen, and where said connector includes at least one signal contact to be connected to said signal carrier and a connector body, comprising:

a ferrule of electrically conductive material having inner and outer concentric tubular portions with front ends that are joined, to leave a rearwardly-opening cavity;

said inner tubular portion lies radially inside said screen and said outer tubular portion lies outside at least said screen and is crimped around said screen;

said connector body includes a rearward projection that comprises a tube that lies around and is crimped to said outer tubular portion of said ferrule.

* * * * *